US012753659B2

(12) United States Patent
DiFoggio

(10) Patent No.: US 12,753,659 B2
(45) Date of Patent: Oct. 6, 2026

(54) VIBRATIONAL DAMPER FOR ELEVATED TEMPERATURES

(71) Applicant: Baker Hughes Oilfield Operations LLC, Houston, TX (US)

(72) Inventor: Rocco DiFoggio, Houston, TX (US)

(73) Assignee: BAKER HUGHES OILFIELD OPERATIONS LLC, Houston, TX (US)

( * ) Notice: Subject to any disclaimer, the term of this patent is extended or adjusted under 35 U.S.C. 154(b) by 0 days.

(21) Appl. No.: 18/924,576

(22) Filed: Oct. 23, 2024

(65) Prior Publication Data

US 2025/0129676 A1 Apr. 24, 2025

Related U.S. Application Data

(60) Provisional application No. 63/592,671, filed on Oct. 24, 2023.

(51) Int. Cl.
*E21B 17/07* (2006.01)

(52) U.S. Cl.
CPC ..... *E21B 17/07* (2013.01)

(58) Field of Classification Search
CPC ..... E21B 17/07
See application file for complete search history.

(56) References Cited

U.S. PATENT DOCUMENTS

| | | | | |
|---|---|---|---|---|
| 2,363,269 | A * | 11/1944 | Schlumberger | E21B 33/134 166/60 |
| 5,510,582 | A | 4/1996 | Birchak et al. | |
| 9,476,261 | B2 | 10/2016 | Venugopal et al. | |
| 11,208,853 | B2 | 12/2021 | Peters et al. | |
| 2013/0256031 | A1 | 10/2013 | Lee | |
| 2021/0079976 | A1 | 3/2021 | Peters | |

OTHER PUBLICATIONS

Moritz, H. U., "Increase in viscosity and its influence on polymerization processes", Chemical & Engineering Technology, vol. 12: Issue 1, 1989, pp. 71-87.
Cernosek, Z. et al., "Sulfur—a new information on this seemingly well-known element", Journal of Non-oxide Glasses, vol. 1, No. 1, 2009, pp. 38-42.
Chandler, H.D., "Activation entropy and anomalous temperature dependence of viscosity in aqueous suspensions of Fe2O3", Powder Technology, 305, 2017; pp. 572-577.
Fluid Power Journal, "Ensure Temperature and Viscosity Compatibility", Mar. 15, 2018 retrieved online at: https://fluidpowerjournal.com/ensure-temperature-viscosity-compatibility/; 5 pages.

(Continued)

*Primary Examiner* — Robert E Fuller
(74) *Attorney, Agent, or Firm* — CANTOR COLBURN LLP

(57) ABSTRACT

A work string and method of absorbing a vibration at the work string. The work string includes an outer member, an inertial mass disposed within the outer member and a damping element between the outer member and the inertial mass. The damping element includes a liquid having a viscosity that increases with increasing temperature. The damping element absorbs the vibration being transferred from the outer member to the inertial mass.

22 Claims, 7 Drawing Sheets

(56) References Cited

OTHER PUBLICATIONS

Gao, H. et al., "Mathematical Modelling and Computational Simulation of the Hydraulic Damper during the Orifice-Working Stage for Railway Vehicles", Mathematical Problems in Engineering, vol. 2020, Article ID 1830150; 23 pages.
Heinisch et al., "Simulation and Testing of an Isolator Tool for High-Frequency Torsional Oscillation"; Society of Petroleum Engineers; SPE-193313-MS; Abu Dhabi International Petroleum Exhibition & Conference; Nov. 12-15, 2018; 10 Pages.
International Search Report and Written Opinion, International Application No. PCT/US2024/052585, mailed Dec. 5, 2024; 6 pgs.
Kandy, S. et al., "Temperature-Induced Aggregation in Portlandite Suspensions", ACS Publications, American Chemical Society, Langmuir: Aug. 2020; 20 pages.
Prashant et al., "Effect of nano-alumina concentration on the mechanical, rheological, barrier and morphological properties of guar gum", Dec. 1, 2015, vol. 53; No. 4; p. 1948-1956, DOI: 10.1007/S13197-015-2114-7.
Scopigno et al., "On the origin of the lambda-transition in liquid Sulphur", arxiv.org, Cornell University Library, Ithaca, NY 14853, Jun. 1, 2007, DOI: 10.1103/PHYSREVLETT.99.025701.
Sofekun, G., "Rheometric Properties of Pure Liquid Elemental Sulfur", The Vault Open Theses and Dissertations, Aug. 2017, retrieved from PRISM Repository, University of Calgary; 124 pages.

* cited by examiner

VIBRATIONAL DAMPER FOR ELEVATED TEMPERATURES

BACKGROUND

This application claims the benefit of an earlier filing date from U.S. Provisional Application Ser. No. 63/592,671, filed Oct. 24, 2023, the entire disclosure of which is incorporated herein by reference.

In the resource recovery industry, a string is conveyed into a borehole to perform a downhole operation. The string can experience vibrations and shocks during operation within a borehole, such as a due to drilling operations, completion operations, stimulation operations, production operations, etc. These shocks and vibrations can cause damage to equipment that has been conveyed downhole with the string. Therefore, there is a need to be able to protect this equipment from shocks and vibrations that occur during normal downhole operations.

SUMMARY

Disclosed herein is a work string including an outer member, an inertial mass disposed within the outer member, and a damping element between the outer member and the inertial mass, the damping element including a liquid having a viscosity that increases with increasing temperature.

Also disclosed herein is a method of absorbing a vibration at a work string. A damping element is disposed between an outer member and an inertial mass disposed within the outer member, wherein the damping element includes a liquid having a viscosity that increases with increasing temperature. The vibration being transferred from the outer member to the inertial mass is absorbed by the damping element.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
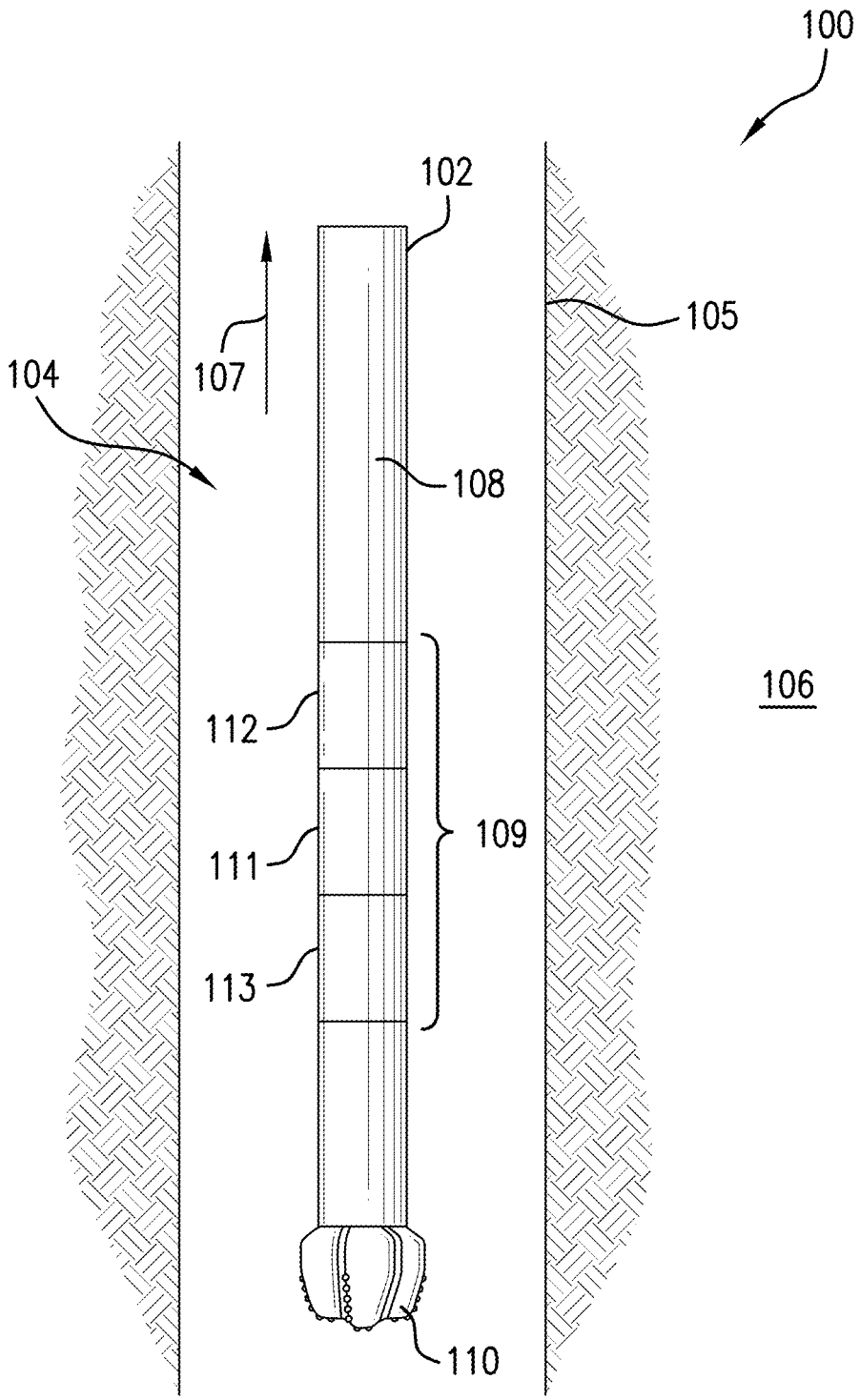
FIG. 1 shows a downhole system in an illustrative embodiment.

Referring to FIG. 1, a downhole system 100 is shown in an illustrative embodiment. The downhole system 100 includes a work string 102 disposed in a borehole 104 formed in a formation 106. The borehole 104 is filled with a borehole fluid 107 that pumped through the borehole. The work string 102 defines with a borehole wall 105 an annulus which provides a path for the borehole fluid 107 to return to the earth surface after it has been pumped through the work string 102 to the bottom of the borehole 104, cleaning the borehole from cuttings. For illustrative purposes, the work string is shown in FIG. 1 as a drill string. However, any work string can be suitable for use with the methods disclosed herein, including a production string, a completion string, etc. The drill string includes a drill bit 110 at a bottom end for disintegrating the formation at the bottom of the borehole. Operation of the drill bit 110 produces vibrations and shocks along the length of the drill string. The drill string includes drill pipes 108 and a bottom hole assembly (BHA) 109. The drill string rotates while cutting the formation with the drill bit 110. The cutting process induces torsional vibration, such as high frequency torsional vibration (HFTO) in the BHA. HFTO typically have frequencies above 50 Hz. Beside torsional vibration downhole operation can also cause axial vibration or lateral vibration. Damping devices and methods disclosed herein absorb the vibrations and shocks to reduce their impact on the work string 102 and on devices included in a BHA within a work string 102, such as formation evaluation tools 111 (FE tools) or measurement while drilling devices 112 (MWD tools). The BHA also includes the damping device 113. Reducing impacts of formation evaluation FE or MWD tools avoids premature damage and improves the measurement quality.

Figure 2:
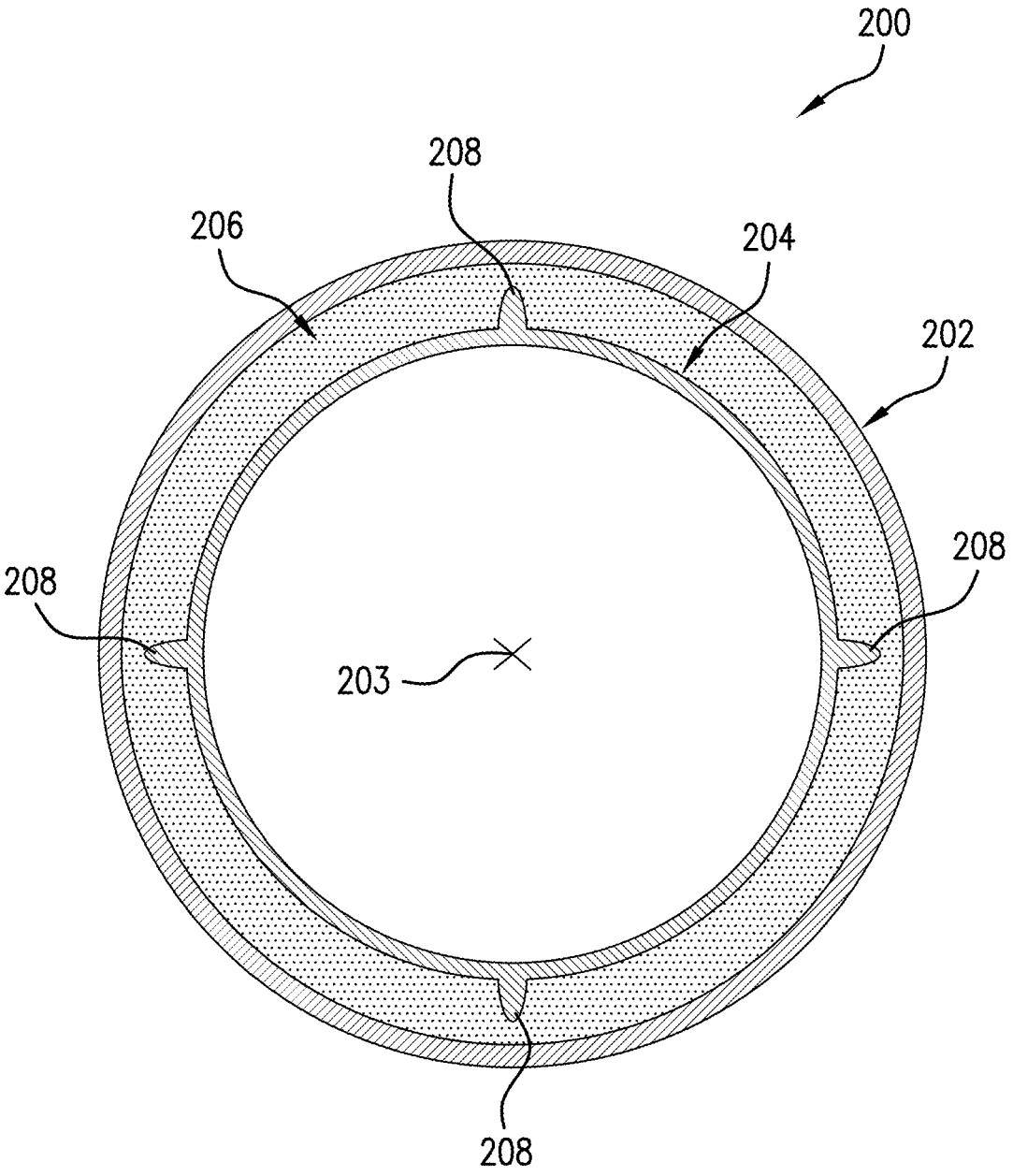
FIG. 2 shows a cross-section of the work string at a selected location along the work string, in an embodiment.

FIG. 2 shows a cross-section 200 of the work string 102 at a selected location along the work string 102, in an embodiment. The cross-section 200 shows an outer member 202 and an inner member 204. The outer member 202 can be an outer tubular of the work string 102 and the inner member 204 is configured to move relative to the outer member 202. The inner member 204 may be an inner tubular of the work string 102. Operation of the work string 102 generally generates vibrations that propagate through the work string 102. In an embodiment, the outer member 202 forms an outer cylindrical shell and the inner member 204 forms an inner cylindrical shell that is disposed within the outer cylindrical shell and shares a common longitudinal axis 203. The inner member 204 is an inertial mass that absorbs the shock or the vibration that occurs at the work string 102 during operation. The inner member 204 is formed from a material with a large density such as for example tungsten. A damping element 206 is disposed between the outer member 202 to the inner member 204 and is fit snugly between them to allow vibrations to transfer from the outer member 202 to the inner member 204. The damping element 206 includes a damping material that absorbs the energy of vibrations being transferred from the outer member 202 to the inner member 204. The damping material is an elastomeric material having a plurality of open-cell pores having a viscous liquid therein. The elastomeric material together with the viscous liquid form the damping element 206. In an embodiment, the open-cell pores allow the damping element to have a high degree of porosity, with interconnection of the majority of the pores within the damping element. The inner member 204 includes bumpers 208 on its outer surface that prevent clanging of the inner and outer members against one another and enhance coupling between the inner member 204 and the damping element 206, as shown in detail in FIG. 3. There is also friction acting between the inner member 204 and the damping element 206 which ensures that the damping element 206 is deformed due to the movement of the inner member 204. In an alternative embodiment the damping element 206 is glued or vulcanized to the outer surface of the inner member 204. The volume between the inner and outer member is filled completely with the material of the damping element 206. The outer member 202 includes the outer surface of the work string or the BHA and is in contact with the borehole fluid. A typical outer diameter of the outer member 202 relates to typical BHA diameters as used in downhole operations, such as 4¾ inch, 6¾ inch, or 9½ inch. The radial distance (perpendicular to the longitudinal axis 203) between the outer member 202 and the inner member 204 is between 1 inch and 5 inch. The axial length of the inner member may be between 0.2 m and 1 m, or between 0.5 and 2 m.

Figure 2A:
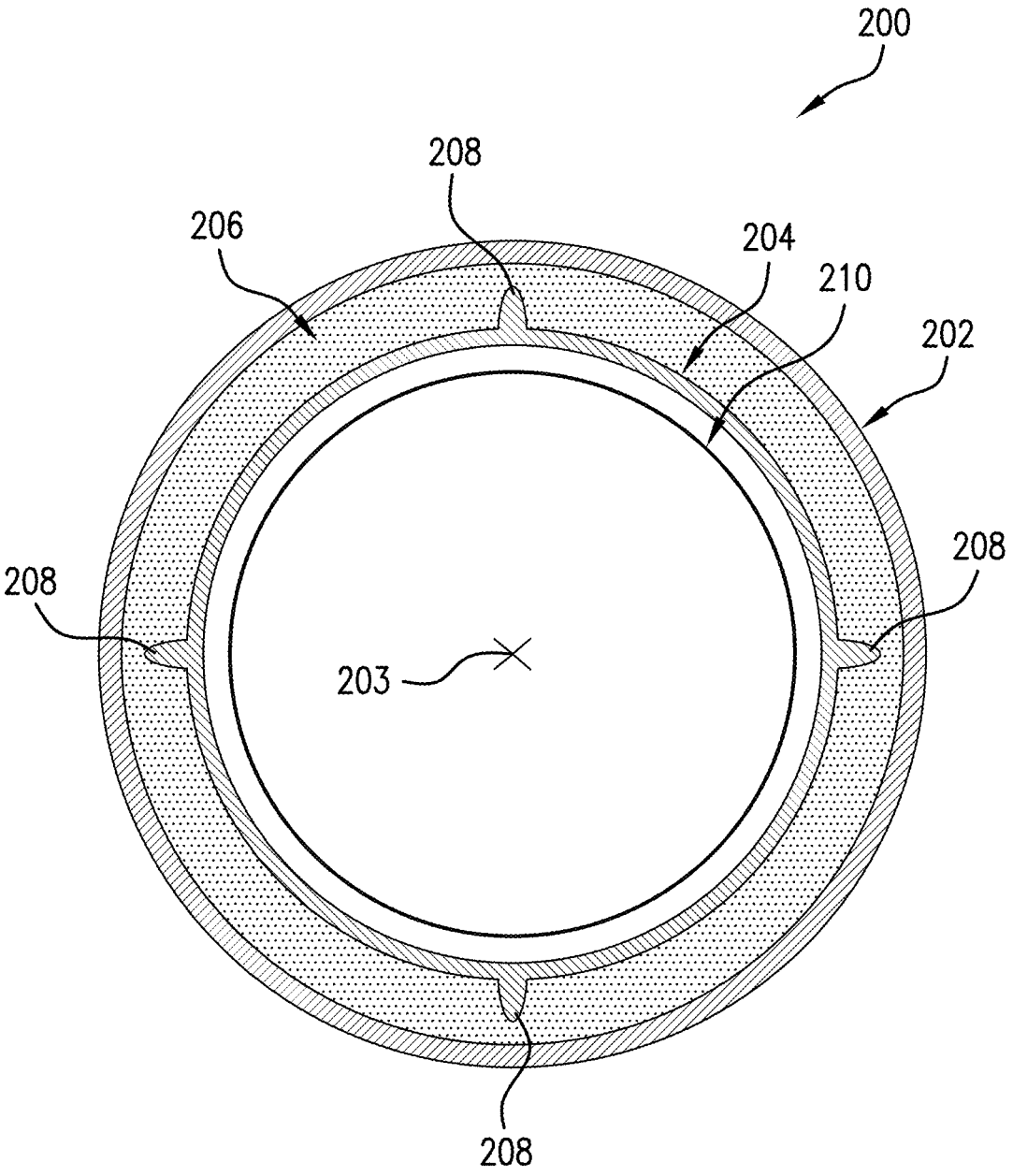
FIG. 2A shows the cross-section of the work string in an alternative embodiment.

FIG. 2A shows the cross-section 200 of the work string 102 in an alternative embodiment. The inner member 204 is disposed between an inner tubular 210 and the outer member 202. The inner tubular 210 is part of the work string 102 and is configured to transfer torque to the drill bit in a drilling operation. The inner member 204 surrounds the inner tubular 210 and is rotationally movable relative to the inner tubular 210 and the outer member 202. The damping element 206 is disposed in the annular space between the inner member 204 and the outer member 202. There may be a bearing element (not shown) between the inner tubular 210 and the inner member 204. In one more alternative embodiment, the inner member 204 is surrounded by the damping element 206 and the damping element is disposed in an annular space between the inner member 204 and the outer member 202 and in an annular space between the inner tubular 210 and the inner member 204. The open-cell pores at the axial ends of the damping element 206 may be closed by melting the elastomeric material or by applying a scaling material such as room-temperature vulcanizing silicone (e.g. RTV). In one more alternative embodiment, the axial ends of the damping element 206 may be covered by a rim (e.g. a metal rim), which is mechanically connected to the outer member 202 and is slidingly coupled to the inner member 204 and/or the inner tubular 210 to preserve the capability of the inner member 204 to move relative to the outer member 202.

Figure 3:
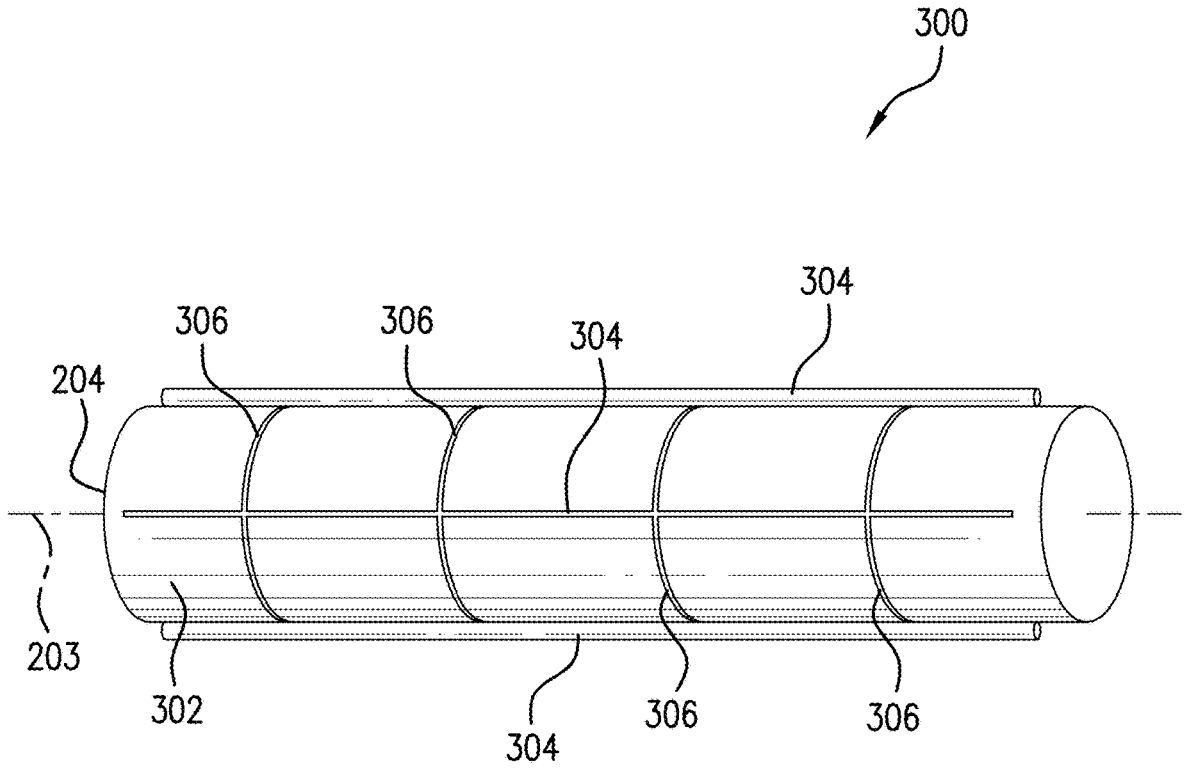
FIG. 3 shows a perspective view of the inner member. in an illustrative embodiment.

FIG. 3 shows a perspective view 300 of the inner member 204 in an illustrative embodiment. The inner member 204 has an outer surface 302 with a set of axial bumpers 304 extending along a longitudinal axis 203 of the inner member 204. The outer surface 302 also has a set of circumferential bumpers 306 extending around a circumference of the inner member 204 and are periodically spaced from each other along the longitudinal axis 203. The set of axial bumpers 304 support the transfer of torsional movement of the inner member 204 to the damping element 206 and consequently provide damping of torsional vibrations of the work string 102. The set of circumferential bumpers 306 support the transfer of axial movement of the inner member to the damping element 206 and consequently provide damping of axial vibrations of the work string 102. In alternative embodiments, the damping device includes either axial bumpers making the damping device to serve as an axial vibration damping device, or radial bumpers making the damping device to serve as a torsional damping device.

Referring again to FIG. 2, the open-cell pores are partially filled with a liquid that has a viscosity that increases with temperature. In an illustrative embodiment, the open-cell pores are about ⅔ filled with the liquid. In an alternative embodiment, the open-cell pores are filled by 80% or by 90%. The remainder of the pore volume optionally is filled with a gas, such as air. A throat size between two neighboring open-cell pores is between 5 μm and 1000 μm, between 10 μm and 700 μm, or between 100 μm and 500 μm. The liquid is selected to be viscous at downhole temperatures. The liquid may also be selected to have increasing viscosity with increasing temperature, which is a phenomenon that is rare and anomalous, and not widely known. Because it is firmly fixed in most people's minds that the viscosity of a liquid always decreases with increasing temperatures, it is an unexpected result that it is possible to construct a liquid viscous damper whose damping does not decrease with increasing temperatures. In fact, for most liquids, viscosity n decreases exponentially with inverse temperature T as in the 1913 Andrade equation, where $\eta = A \exp(B/T)$ with fitting parameters, A and B determined for each liquid. In an embodiment, the liquid is liquid sulfur, which due to polymerization, becomes more viscous with increasing temperature. In an alternative embodiment, the liquid can be a suspension of particles of calcium hydroxide Ca $(OH_2)$ in water (aqueous) for which viscosity increases with increasing temperature due to precipitation of micron size particles in the suspension at higher concentrations. Similarly, the viscosity of a suspension of iron (III) oxide $Fe_2O_3$ particles in water (aqueous) increases with increasing temperature. For any suspension of particles in water, pressure is maintained on the liquid to prevent the water from boiling. For example, a pressure can be maintained at the water vapor pressure of 225 psi for a borehole temperature of 200° C. Table 1, which is excerpted from the 2017 Sofekun paper, "Rheometric Properties of Pure Liquid Elemental Sulfur", gives the viscosity of liquid sulfur as a function of temperature.

TABLE 1

| T [° C.] | η [cP] |
|---|---|
| 150.0 | 4.7 |
| 155.0 | 4.0 |
| 160.0 | 11.7 |
| 165.0 | 6392.4 |
| 170.0 | 24176.6 |
| 175.0 | 40290.9 |
| 180.0 | 50579.6 |
| 185.0 | 55782.3 |
| 190.0 | 56363.5 |
| 195.0 | 53747.5 |
| 200.0 | 49121.7 |
| 205.0 | 43341.6 |
| 210.0 | 37360.9 |

Figure 4:
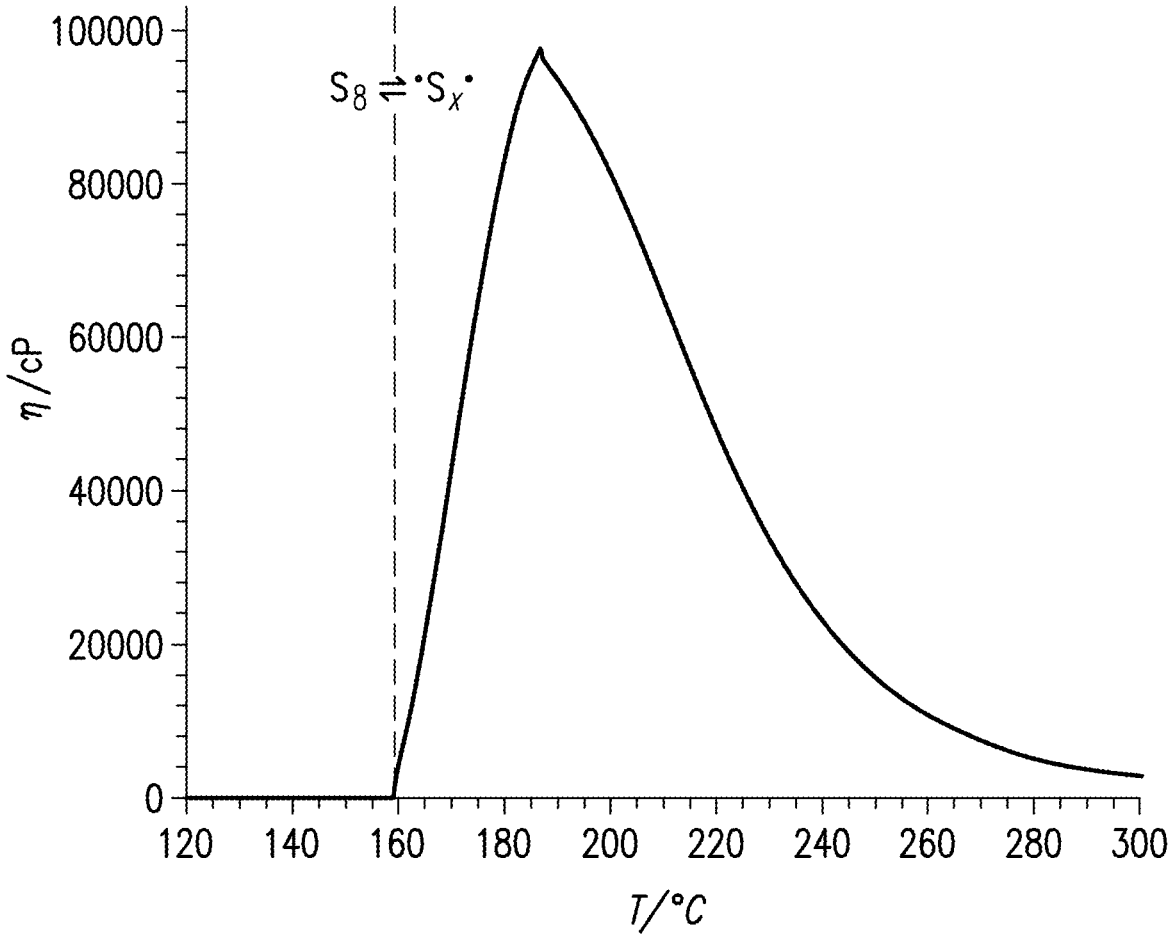
FIG. 4 shows a graph of viscosity vs. temperature for liquid sulfur.

Sulfur melts at 112.8° C., which puts it into a liquid state at almost all downhole temperatures. The viscosity of liquid sulfur is low at temperatures less than about 160° C. and increases considerably in a temperature range between 160° C. and 165° C. A peak in the viscosity of liquid sulfur occurs at about 190° C. A graph of the viscosity versus temperature is shown in FIG. 4. Because liquid sulfur is partially filling the damping element 206, there are two mechanisms available for absorbing energy between outer member 202 and inner member 204. Firstly, energy loss occurs due to the elastomeric deformation of the porous elastomer. Secondly, energy loss occurs due to viscous energy losses from the viscous liquid sulfur moving between the open-cell pores of the porous elastomer.

In particular, the deformation losses of the matrix material is expected to decrease with increasing temperature. An elastomer of silicone rubber is mostly inert to chemical reactions with filling liquids at temperatures up to about 200° C. Due to the rise in the viscosity of the liquid sulfur with temperature, the viscous energy losses can dominate over the elastomeric deformation losses at higher temperatures, which are within the typical borehole temperature range of up to 200° C. In an alternative embodiment, the elastomer may be polyurethane configured to be deployed at high temperature, such as 200° C. At the temperatures at which the filling liquids are in a solid state, the damping mechanism in the vibration damping device solely is based on the deformation the elastomer material.

Figure 5:
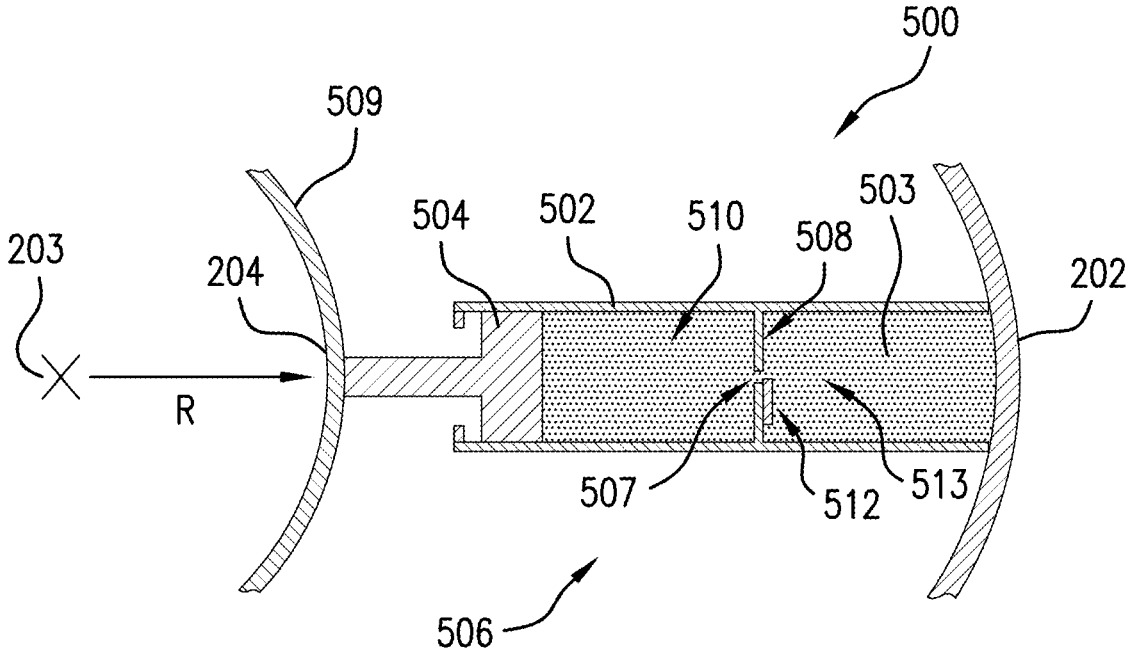
FIG. 5 is a schematic diagram depicting the damping element in another embodiment.

FIG. 5 is a schematic diagram 500 depicting the damping element 506 in another embodiment. The damping element 506 includes a first chamber 502 having a piston 504 and an aperture 507. As shown in the embodiment in the schematic diagram 500, the piston 504 is at one end of the first chamber 502 and the aperture 507 is at an opposite end of the first chamber 502, however, the aperture can be at any position in the first chamber 502. The piston 504 can be coupled to the inner member 204. A second chamber 503 is in fluid communication with the first chamber 502. The aperture 507 forms a pathway for a liquid 510 to move from the first chamber 502 to the second chamber 503. A shutter device 512 is operatively connected to a wall of one of the first chamber 502 and the second chamber 503. The aperture 507 and the shutter device 512 form a valve 513. The second chamber 503 is coupled to the outer member 202. The outer member 202 forms a wall of the second chamber 503. In an alternative embodiment, the first chamber 502 includes a plurality of first chambers and the second chamber 503 includes a plurality of second chambers. In yet another embodiment, there is at least one chamber (not shown) between the first chamber and the second chamber. The first chamber 502 and the at least one chamber between the first and second chamber each have an aperture and a shutter device. Aperture 507 may be small (about 0.5 mm to 2 mm in diameter) to provide a significant pressure drop between the pressure in the first and second chamber and corresponding viscous energy loss and damping when a viscous liquid flows through it. The liquid 510 (e.g., the liquid sulfur) is stored in the first chamber 502 and in the second chamber 503. When vibration occurs and the inner member starts moving (such as oscillating), the piston 504 moves into the first chamber 502 causing an increase of pressure in the first chamber 502. Consequently, the liquid 510 is moved through the aperture 507 into the second chamber 503. When the piston 504 moves in the opposite direction, the pressure in the first chamber 502 decreases causing the liquid 510 to move back from the second chamber 503 into the first chamber 502. In an embodiment, the shutter device 512 covers the aperture 507 and is controllable (such as by temperature variation) to move with respect to the aperture 507 to close the aperture 507 and to open the aperture 507, either fully or partially, so as to reduce the variation in pressure drop (and damping) as the viscosity increases with increasing temperature. That is, the shutter device 512 is almost closed when the liquid's viscosity is lowest, and the shutter device 512 is fully open when the liquid's viscosity is highest. The shape of the aperture 507 and the shape of the shutter device 512 can be arbitrary. An amount of open area at the aperture 507 increases nonlinearly with linear movement of the shutter device 512 to try to match any nonlinear increase in viscosity with temperature. This may be achieved by making the aperture 507 and or the shutter device 512 having a complex shape, which may be determined using a numerical simulation. However, for illustrative purposes, only a circular aperture and circular shutter device are shown. In the schematic diagram of FIG. 5, the damping element 506 is configured to dampen lateral vibration. That is, the inner member 204 moves or oscillates in a radial direction, perpendicular to the longitudinal axis 203. In alternative embodiments, the damping element 506 is configured to allow damping of axial or torsional vibration. To dampen axial vibration, the damping element 506 is oriented parallel to the longitudinal axis and the inner member 204 is configured to move or oscillate parallel to the longitudinal axis 203. To dampen torsional vibration, the damping element 506 is oriented tangential to the circumference 509 of the inner member, perpendicular to the longitudinal axis 203 and perpendicular to the radial direction. The inner member 204 is configured to rotate or oscillate around the longitudinal axis 203.

Figure 6:
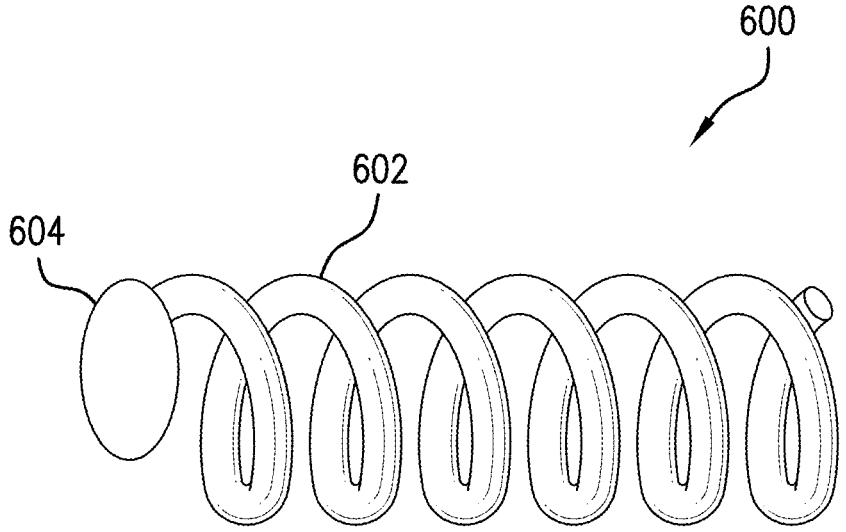
FIG. 6 shows a diagram of the valve in an embodiment.

FIG. 6 shows a diagram 600 of the shutter device 512 in an embodiment. The shutter device 512 includes a coiled spring 602 and a shutter plate 604 disposed at an end of the coiled spring 602. The purpose of the coiled spring 602 is to passively open the valve 513 with increasing temperature using only thermal expansion of the spring and, thereby, avoid the need for any active control electronics and corresponding actuator. The shutter plate 604 can be a flat circular plate that can be placed up against the planar surface 508 and which mostly covers the aperture 507 when in a first position. The coiled spring 602 lengthens with increasing temperature and contracts with decreasing temperature. Due to its helical shape, the lengthening (or contracting) of the coiled spring causes a rotation of the very end of the coiled spring 602. For angles of rotation less than 25 degrees, which is only about 6% of a full 360-degree rotation, the motion is approximately linear and substantially tangent to the end of the coil. As a result, heating the coiled spring 602 causes the shutter plate 604 to move almost linearly in and out of position covering the aperture 507 as shown in FIG. 7.

Figure 7:
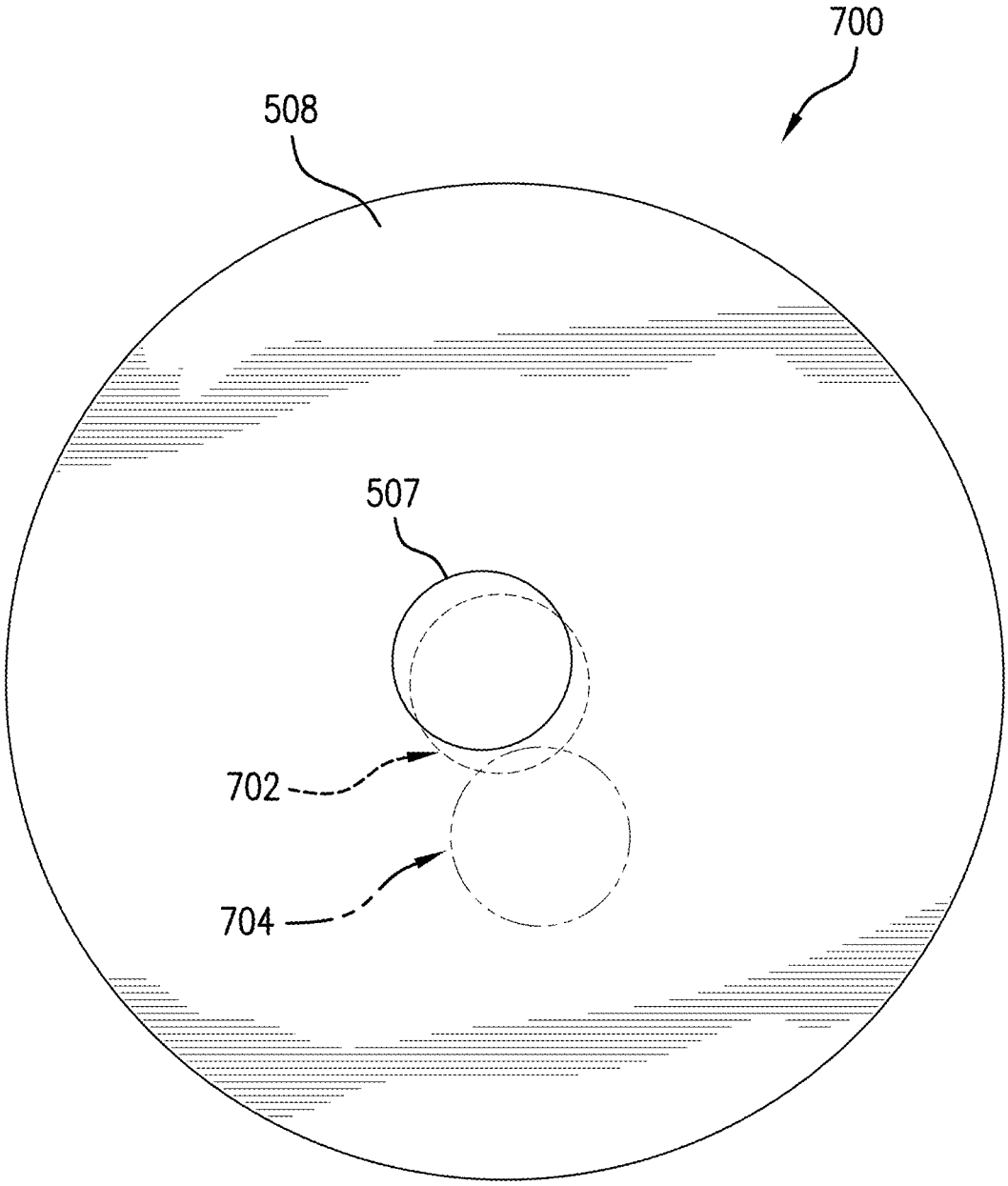
FIG. 7 shows a side view of the planar surface of the chamber.

FIG. 7 shows a side view 700 of the planar surface 508 of the chamber 502. When at a first, lower temperature, the coiled spring 602 holds the shutter plate 604 in the first position 702 (shown as a dashed circle) nearly covering the aperture 507 for the lowest viscosity liquid. When heated to a second, higher temperature, the coiled spring 602 wire lengthens and moves the shutter plate 604 to a second position 704 (shown as a dotted and dashed circle) that leaves the aperture 507 completely uncovered. Changing the size of the aperture 507 controls the flow of the liquid (e.g the liquid sulfur) flowing from the first chamber 502 to the second chamber 503 or vice versa, thereby controlling the damping ability of the damping element 506. The aperture size can be changed to maintain the same pressure drop across the aperture over a temperature range at which the liquid has high viscosity. To get the most movement with the shortest free length coiled spring 602, a high-temperature coiled polymer spring can be used instead of a coiled steel spring. In an embodiment, the coiled spring 602 can be formed from an Ultem (polyetherimide) wire, made by Lee Spring of Brooklyn, New York, which has about five times the thermal coefficient of expansion of a steel wire and a heat deflection temperature of 204° C. A one-inch diameter, Ultem coil spring, LL 100 125 U30G, has 4 wire loops within a normal free length of one inch and a total wire length of 64 mm, which increases by 0.25 mm as temperature rises from 120° C. to 200° C. Four such springs in series are only 4 inches long and provide a 1.00 mm movement over a 1 mm aperture over this temperature range in a compact space. The temperature of the coiled spring 602 is determined by the environment of the work string 102, such as the temperature in the borehole 104 (FIG. 1). The coiled spring 602 is heated when the temperature in the borehole 104 increases, such as by drilling deeper into the earth crust or is cooled when the temperature in the borehole is decreasing, such as increasing a flow rate of the borehole fluid 107, which cools the borehole 104 and the work string 102.

In another embodiment, a high frequency torsional oscillation damper for a drill string is a ring damper that employs one or more heavy rings rotating with little clearance inside the drill string. The rings can be made of lead or tungsten. The clearance is filled with liquid sulfur or some other liquid whose viscosity increases with increasing temperature. The ring damper is similar to an automotive crankshaft damper like those that are described online (https://faiauto.com/viscous-vibration-dampers/, https:///www.hassewrede.com/en/products/visco-damper/, and https://publications.lib.chalmers.se/records/fulltext/238131/238131.pdf), which may use a dual-mass flywheel.

SPE-193313-ms discusses downhole torsional dampers and states below FIG. 1 that a "very similar principle is used in the automotive industry for isolating torsional vibration". Also, U.S. Pat. Nos. 9,476,261 and 11,208,853 describe downhole torsional oscillation dampers. Generally, silicone oil is used as the viscous fluid in these dampers because its viscosity does not drop as rapidly at elevated temperature as do mineral or vegetable oils. However, none of the prior art uses a liquid whose viscosity increases with temperature.

Set forth below are some embodiments of the foregoing disclosure:

Embodiment 1: A work string. The work string includes an outer member, an inertial mass disposed within the outer member and a damping element between the outer member and the inertial mass, the damping element including a liquid having a viscosity that increases with increasing temperature.

Embodiment 2. The work string of any prior embodiment, the damping element further comprises a matrix material having open-cell pores, wherein the liquid partially fills the open-cell pores.

Embodiment 3. The work string of any prior embodiment, the matrix material includes an elastomer.

Embodiment 4. The work string of any prior embodiment, the liquid is one of: (i) liquid sulfur; (ii) aqueous suspension of calcium hydroxide $Ca(OH)_2$; and (iii) aqueous suspension of iron (III) oxide $Fe_2O_3$.

Embodiment 5. The work string of any prior embodiment, the outer member is an outer tubular of the work string and the inertial mass is an inner tubular of the work string.

Embodiment 6. The work string of any prior embodiment, further including one of: (i) a drill string; (ii) a production string; and (iii) a completion string.

Embodiment 7. The work string of any prior embodiment, the damping element further comprises a chamber that includes the liquid, the chamber having a piston and a valve for controlling a pressure of the liquid in the chamber.

Embodiment 8. The work string of any prior embodiment, the valve includes a coiled spring and a shutter plate at an end of the coiled spring, wherein the coiled spring is configured to control a position of the shutter plate with respect to an aperture of the chamber and moves the shutter plate with respect to the aperture via heating and cooling of the coiled spring.

Embodiment 9. The work string of any prior embodiment, wherein a linear motion of the shutter plate over the aperture produces an open area that increases nonlinearly, wherein the nonlinear increase in the open area of the aperture mimics a nonlinear increase in the viscosity of the liquid.

Embodiment 10. The work string of any prior embodiment, wherein the heating and cooling is determined by a temperature of the environment of the work string.

Embodiment 11. The work string of any prior embodiment, wherein the inertial mass is configured to move around an inner tubular of the work string.

Embodiment 12. A method of absorbing a vibration at a work string. The method includes disposing a damping element between an outer member and an inertial mass disposed within the outer member, wherein the damping element includes a liquid having a viscosity that increases with increasing temperature, and absorbing the vibration being transferred from the outer member to the inertial mass via the damping element.

Embodiment 13. The method of any prior embodiment, wherein the damping element further comprises a matrix material having open-cell pores, wherein the liquid partially fills the open-cell pores.

Embodiment 14. The method of any prior embodiment, wherein the liquid is one of: (i) liquid sulfur; (ii) aqueous suspension of calcium hydroxide $Ca(OH)_2$; and (iii) aqueous suspension of iron (III) oxide $Fe_2O_3$.

Embodiment 15 The method of any prior embodiment, wherein the outer member is an outer tubular of the work string and the inertial mass is an inner tubular of the work string.

Embodiment 16. The method of any prior embodiment, wherein the damping element further comprises a chamber that includes the liquid, the chamber having a piston and a valve for controlling a pressure of the liquid in the chamber.

Embodiment 17. The method of any prior embodiment, wherein the valve comprises a coiled spring and a shutter plate at an end of the coiled spring whose thermal coefficient of expansion lets it passively control a position of the shutter plate with respect to an aperture of the chamber, further comprising changing a temperature of the coiled spring to move the shutter plate with respect to the aperture to change a size of the aperture.

Embodiment 18. The method of any prior embodiment, wherein a shape of at least one of the aperture and the shutter plate is determined by a numerical simulation.

Embodiment 19. The method of any prior embodiment, wherein changing the temperature of the coiled spring is determined by a temperature of the environment of the work string.

Embodiment 20. The method of any prior embodiment, wherein the inertial mass is configured to move around an inner tubular of the work string.

The use of the terms "a" and "an" and "the" and similar referents in the context of describing the invention (especially in the context of the following claims) are to be construed to cover both the singular and the plural, unless otherwise indicated herein or clearly contradicted by context. Further, it should be noted that the terms "first," "second," and the like herein do not denote any order, quantity, or importance, but rather are used to distinguish one element from another. The terms "about", "substantially" and "generally" are intended to include the degree of error associated with measurement of the particular quantity based upon the equipment available at the time of filing the application. For example, "about" and/or "substantially" and/or "generally" includes a range of ±8% of a given value.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A work string, comprising:

an outer member;

an inner tubular;

an inertial mass disposed within the outer member and configured to move around the inner tubular; and a damping element between the outer member and the inertial mass, the damping element including a liquid having a viscosity that increases with increasing temperature.

2. The work string of claim 1, wherein the damping element further comprises a matrix material having open-cell pores, wherein the liquid partially fills the open-cell pores.

3. The work string of claim 2, wherein the matrix material includes an elastomer.

4. The work string of claim 1, wherein the liquid is one of: (i) liquid sulfur; (ii) aqueous suspension of calcium hydroxide $Ca(OH)_2$; and (iii) aqueous suspension of iron (III) oxide $Fe_2O_3$.

5. The work string of claim 1, further comprising one of: (i) a drill string; (ii) a production string; and (iii) a completion string.

6. The work string of claim 1, wherein the damping element further comprises a chamber that includes the liquid, the chamber having a piston and a valve for controlling a pressure of the liquid in the chamber.

7. The work string of claim 6, wherein the valve comprises a coiled spring and a shutter plate at an end of the coiled spring, wherein the coiled spring is configured to control a position of the shutter plate with respect to an aperture of the chamber and moves the shutter plate with respect to the aperture via heating and cooling of the coiled spring.

8. The work string of claim 7, wherein a linear motion of the shutter plate over the aperture produces an open area that increases nonlinearly, wherein the nonlinear increase in the open area of the aperture mimics a nonlinear increase in the viscosity of the liquid.

9. The work string of claim 7, wherein the heating and cooling is determined by a temperature of the environment of the work string.

10. A method of absorbing a vibration at a work string, comprising:

disposing a damping element between an outer member and an inertial mass disposed within the outer member, wherein the damping element includes a liquid having a viscosity that increases with increasing temperature; and absorbing the vibration being transferred from the outer member to the inertial mass via the damping element;

wherein the inertial mass is configured to move around an inner tubular of the work string.

11. The method of claim 10, wherein the damping element further comprises a matrix material having open-cell pores, wherein the liquid partially fills the open-cell pores.

12. The method of claim 11, wherein the matrix material includes an elastomer.

13. The method of claim 10, wherein the liquid is one of: (i) liquid sulfur; (ii) aqueous suspension of calcium hydroxide $Ca(OH)_2$; and (iii) aqueous suspension of iron (III) oxide $Fe_2O_3$.

14. The method of claim 10, wherein the damping element further comprises a chamber that includes the liquid, the chamber having a piston and a valve for controlling a pressure of the liquid in the chamber.

15. The method of claim 14, wherein the valve comprises a coiled spring and a shutter plate at an end of the coiled spring whose thermal coefficient of expansion lets it passively control a position of the shutter plate with respect to an aperture of the chamber, further comprising changing a temperature of the coiled spring to move the shutter plate with respect to the aperture to change a size of the aperture.

16. The method of claim 15, wherein a shape of at least one of the aperture and the shutter plate is determined by a numerical simulation.

17. The method of claim 15, wherein changing the temperature of the coiled spring is determined by a temperature of the environment of the work string.

18. A work string, comprising:

an outer member;

an inertial mass disposed within the outer member;

a damping element between the outer member and the inertial mass, the damping element including a liquid having a viscosity that increases with increasing temperature; and wherein the damping element further comprises a matrix material having open-cell pores, wherein the liquid partially fills the open-cell pores.

19. The work string of claim 18, wherein the outer member is an outer tubular of the work string and the inertial mass is an inner tubular of the work string.

20. The work string of claim 18, wherein the matrix material includes an elastomer.

21. The work string of claim 18, wherein the liquid is one of: (i) liquid sulfur; (ii) aqueous suspension of calcium hydroxide $Ca(OH)_2$; and (iii) aqueous suspension of iron (III) oxide $Fe_2O_3$.

22. The work string of claim 18, further comprising one of: (i) a drill string; (ii) a production string; and (iii) a completion string.

* * * * *